US012247443B2

(12) United States Patent
Koli

(10) Patent No.: US 12,247,443 B2
(45) Date of Patent: Mar. 11, 2025

(54) METHOD FOR ATTACHING RING, RING AND SYSTEM

(71) Applicant: Baker Hughes Oilfield Operations LLC, Houston, TX (US)

(72) Inventor: Jai Kishan Koli, Houston, TX (US)

(73) Assignee: Baker Hughes Oilfield Operations LLC, Houston, TX (US)

( * ) Notice: Subject to any disclaimer, the term of this patent is extended or adjusted under 35 U.S.C. 154(b) by 178 days.

(21) Appl. No.: 17/968,417

(22) Filed: Oct. 18, 2022

(65) Prior Publication Data

US 2024/0125184 A1 Apr. 18, 2024

(51) Int. Cl.
*E21B 17/042* (2006.01)
*E21B 43/08* (2006.01)
*E21B 47/09* (2012.01)

(52) U.S. Cl.
CPC ..... *E21B 17/042* (2013.01); *E21B 43/088* (2013.01); *E21B 47/09* (2013.01)

(58) Field of Classification Search
CPC ..... E21B 43/08; E21B 43/088; E21B 43/084
See application file for complete search history.

(56) References Cited

U.S. PATENT DOCUMENTS 4,378,840 A 4/1983 Lily
4,416,331 A * 11/1983 Lilly ..... B01D 35/18 166/278
5,881,812 A * 3/1999 Malbrel ..... E21B 43/084 166/278
5,931,232 A 8/1999 Echols et al.
6,412,564 B1 * 7/2002 Senior, Jr. ..... E21B 43/088 166/380
9,416,634 B2 * 8/2016 Olenick ..... E21B 43/088
2009/0229823 A1 * 9/2009 Moen ..... E21B 43/088 166/227
2013/0000890 A1 * 1/2013 Olenick ..... B01D 29/48 140/3 R
2014/0060816 A1 * 3/2014 Olenick ..... E21B 43/088 29/896.62

OTHER PUBLICATIONS

Notification of Transmittal of the International Search Report and the Written Opinion of the International Searching Authority, or the Declaration; PCT/US2023/076698; Mail date: Feb. 8, 2024; 9 pages.

* cited by examiner

*Primary Examiner* — David Carroll
(74) *Attorney, Agent, or Firm* — Baker Hughes Patent Organization

(57) ABSTRACT

A method for attaching a ring to a borehole tool including locating the ring on the tool, running a weld bead around the ring without alloying the ring to another parent material, the weld causing contraction in a circumferential dimension of the ring. A method for producing a ring for a downhole tool including forming the ring with a weld groove at an outside surface of the ring. A ring for a downhole tool including a ring body, a weld groove formed in an outside surface of the ring. A borehole system including a borehole in a subsurface formation, a string in the borehole, and a ring disposed on the string.

4 Claims, 3 Drawing Sheets

METHOD FOR ATTACHING RING, RING AND SYSTEM

BACKGROUND

In the resource recovery and fluid sequestration industries there is often need to attach ring structures to other portions of downhole tools. This includes end rings for various tools including screen assemblies. In general, end rings are threaded or welded to the adjacent tool portion but threading and skive cutting are labor intensive and welding to other components often comes with the risk of burn through, especially when the tool portion is thin walled or is a screen segment. The art is always receptive to efficiency and reliability improvements.

SUMMARY

An embodiment of a method for attaching a ring to a borehole tool including locating the ring on the tool, running a weld bead around the ring without alloying the ring to another parent material, the weld causing contraction in a circumferential dimension of the ring.

An embodiment of a method for producing a ring for a downhole tool including forming the ring with a weld groove at an outside surface of the ring.

An embodiment of a ring for a downhole tool including a ring body, a weld groove formed in an outside surface of the ring.

An embodiment, of a borehole system including a borehole in a subsurface formation, a string in the borehole, and a ring disposed on the string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
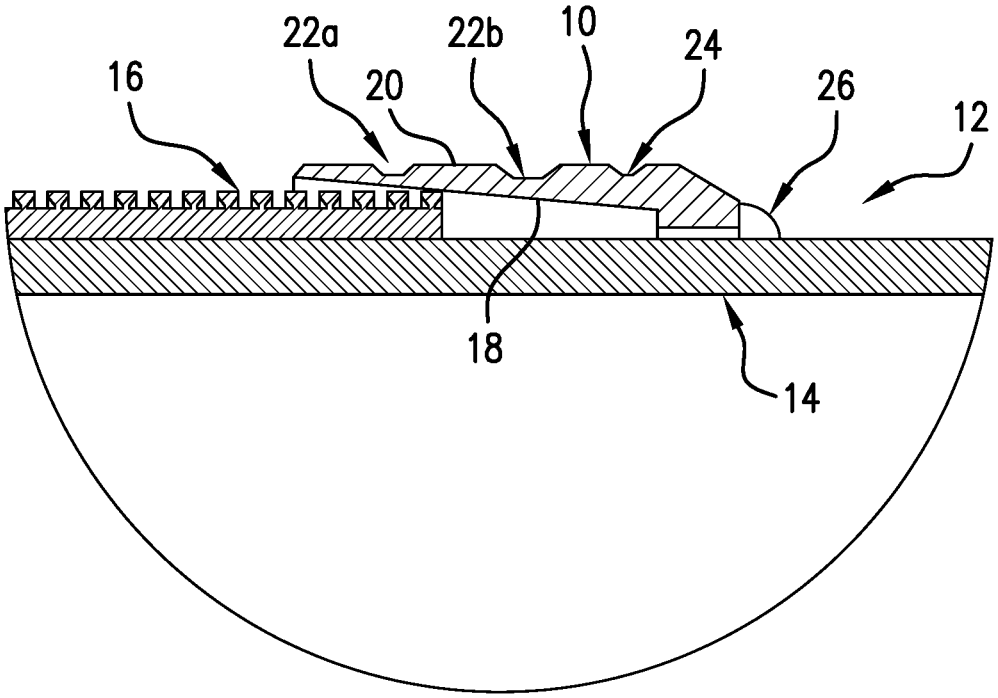
FIG. 1 is a schematic sectional view of a portion of a downhole tool having the ring as disclosed herein disposed thereon.
Figure 2:
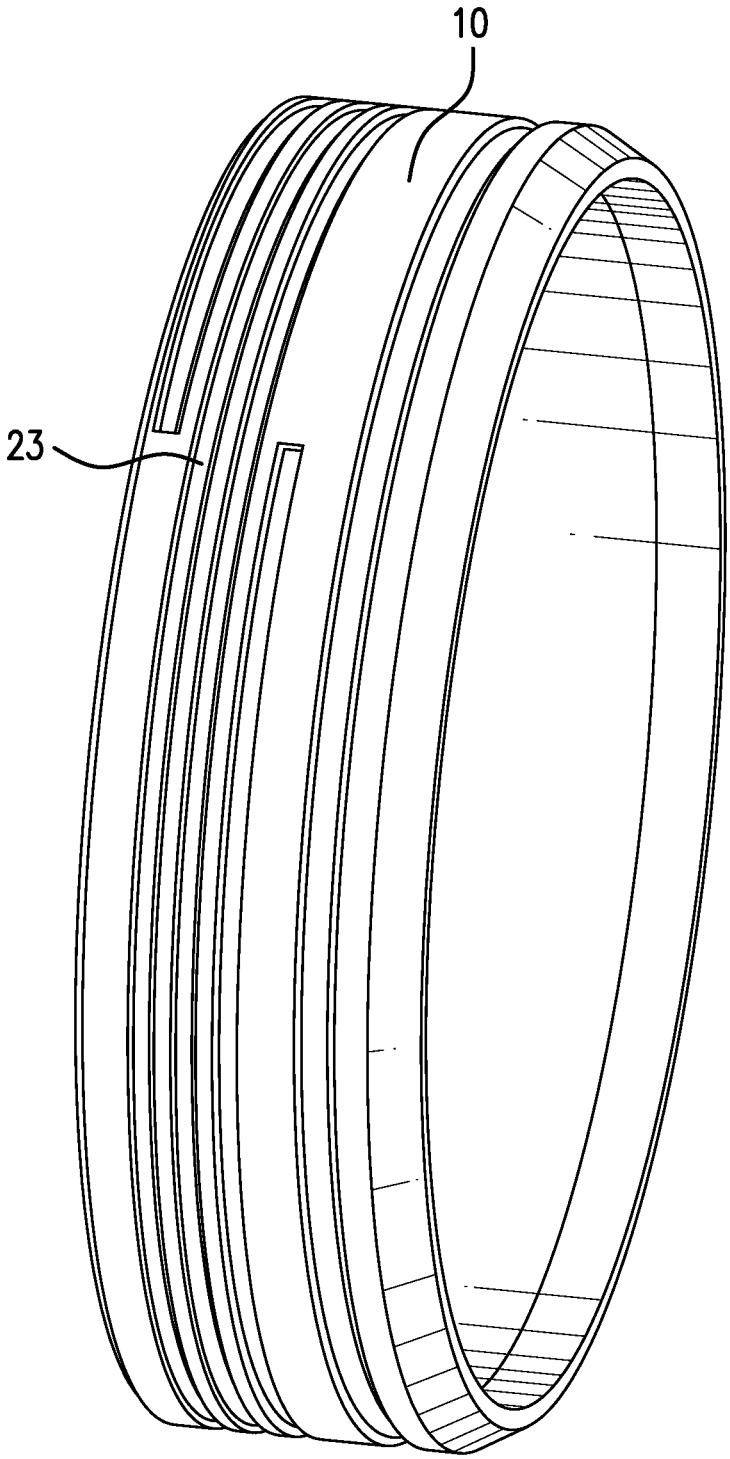
FIG. 2 is an alternate embodiment of FIG. 1.

Referring to FIG. 1, a schematic view of a ring 10 disposed upon a downhole tool 12. The ring 10 itself is novel as well as the combination of the ring with the downhole tool 12. In embodiments, many different downhole tools 12 may benefit by combination with the ring 10. As illustrated, the tool 12 is a sand screen and the ring 10 is configured as an end ring for the screen. It is to be appreciated that any tool that may benefit from the functional attributes of the teaching herein are contemplated including but not limited to the connection of dissimilar metals in a tool. As illustrated, the tool 12 includes a mandrel 14, a screen 16 and the ring 10. The ring 10 comprises a frustoconical inside surface 18, as illustrated. The frustoconical surface 18 allows for infinite adjustability of the ring 10 relative to the mating component, as illustrated, the screen 16. This allows for close contact between the ring 10 and the component (e.g. screen 16), that may be less than a screen slot dimension. An outside surface 20 of ring 10 may in embodiments include one or more weld grooves 22 and one or more deflection features 24, which deflection features 24 may be grooves. Weld grooves 22 are grooves in surface 20 that extend in some embodiments, through a majority of the thickness of the ring 10 in the location of the grooves 22, leaving, for example only, about 0.050 inch of material of the thickness of the ring. The selection of remaining thickness is related to burn through. Providing burn through can be avoided during the weld process, there will be sufficient thickness in a particular embodiment. The groove enhances the shrinkage effect of the weld bead applied to the groove. In one embodiment, each groove 22 is placed circumferentially about the end ring 10 and where more than one groove 22 is employed the grooves 22 are spaced axially from one another. The number and spacing of grooves 22 provides for adjustability to different diameter components (like screen 16). Specifically, the ring 10 may be pushed onto the mandrel 14 until contact is made between the surface 18 and the screen 16. Then the groove 22 located over the screen 16 may be selected to receive a weld bead. Deflection feature 24 allows for enhanced shrinkage of the ring 10 in the area where the shrinkage is desired by flexing the ring at the deflection feature 24. In another embodiment, referring to FIG. 2. The groove 23 is helically disposed about the ring 10. The Embodiments of FIGS. 1 and 2 operate similarly and may use the same parameters.

The method for attaching a ring 10 to a borehole tool 12 comprises locating the ring 10 on the tool 12 by sliding the ring 10 onto the mandrel 14. The ring is slid on until it contacts the screen 16 or other component. Once the ring 10 is in the proper place, it may optionally be welded to the mandrel 14 at bead 26 using standard procedure. It is then determined, in cases where the ring 10 includes more than one weld groove 22, which weld groove 22 is in the correct position relative to the contacting end of the component 16. As illustrated, weld groove **22*a* is in an appropriate place to cause the ring 10 to clamp down toward the component 16. At this point, a weld bead is deposited in the groove 22. The bead may be circumferentially continuous or circumferentially discontinuous as desired with a continuous weld bead causing more shrinkage than a discontinuous bead. Important to note is that the method taught herein does not create alloying of the material of the ring 10 with the material of another component at the weld groove. It does create this alloying at the ring/mandrel interface when welded there as discussed above but the weld bead that is laid in the weld groove 22 does not join the ring 10 to another component in a way that creates alloying. The component 16 and the ring 10 are not joined by melting both parent materials but rather by melting only material of the ring 10 and then taking advantage of weld shrinkage (contraction in the circumferential direction) to drive the ring 10 toward the component 16**.

The ring 10 may be manufactured by either subtractive or additive manufacture.

Figure 3:
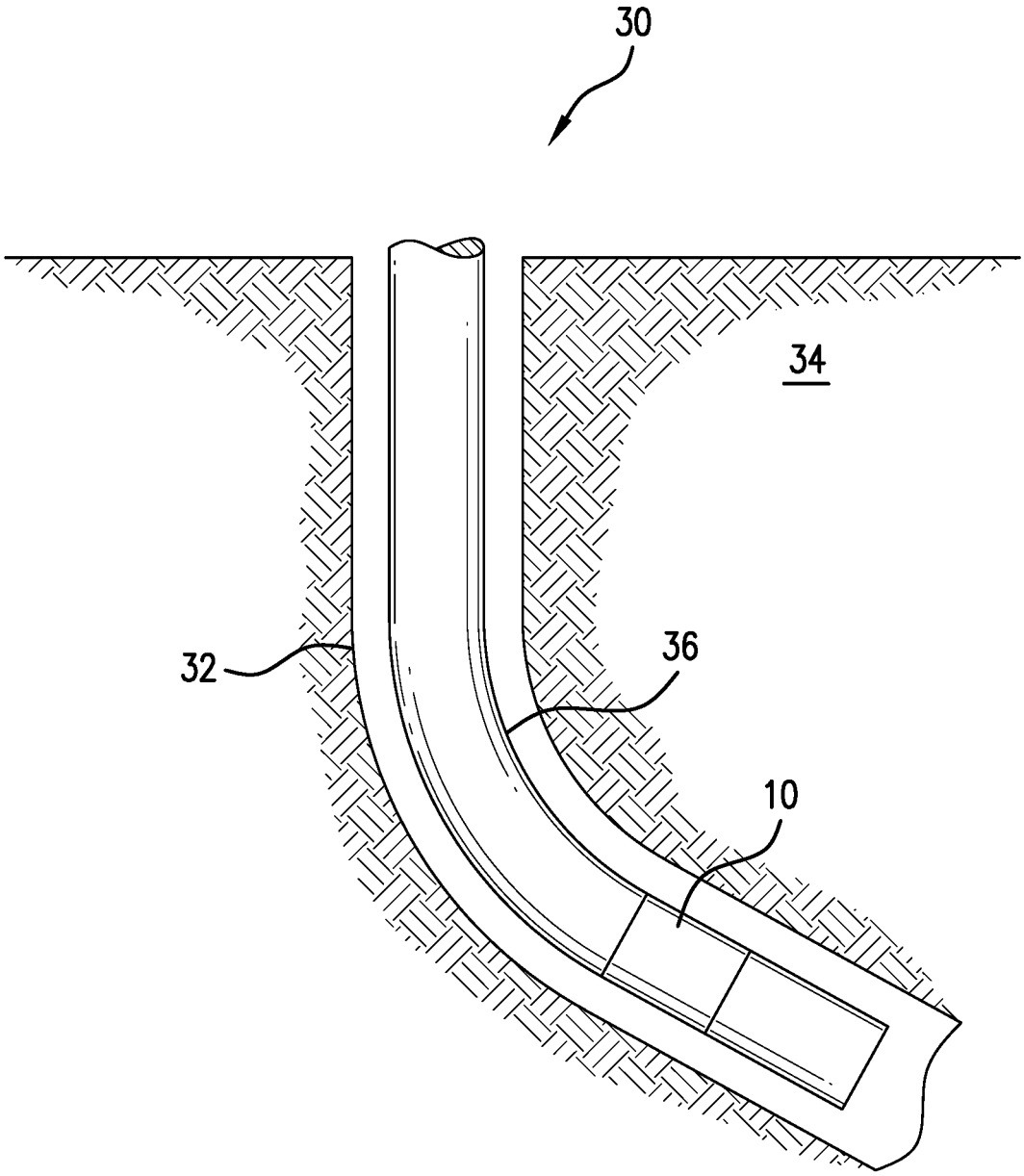
FIG. 3 is a view of a borehole system including the ring as disclosed herein.

Referring FIG. 3, a borehole system 30 is illustrated. The system 30 comprises a borehole 32 in a subsurface formation 34. A string 36 is disposed within the borehole 32. A ring 10 is disposed within or as a part of the string 36 disclosed herein.

Set forth below are some embodiments of the foregoing disclosure:

Embodiment 1: A method for attaching a ring to a borehole tool including locating the ring on the tool, running a weld bead around the ring without alloying the ring to another parent material, the weld causing contraction in a circumferential dimension of the ring.

Embodiment 2: The method as in any prior embodiment, wherein the weld bead is circumferentially or helically continuous.

Embodiment 3: The method as in any prior embodiment, wherein the weld bead is circumferentially or helically discontinuous.

Embodiment 4: The method as in any prior embodiment, wherein the weld bead is arranged in discontinuous stitches circumferentially or helically.

Embodiment 5: The method as in any prior embodiment, further including generating an interference fit by the contraction.

Embodiment 6: The method as in any prior embodiment, wherein the ring and the tool are of dissimilar metals.

Embodiment 7: The method as in any prior embodiment, wherein the locating is adjacent a screen segment, the ring being a screen end ring.

Embodiment 8: The method as in any prior embodiment, wherein the end ring is contracted toward the screen to a spacing from the screen of less than screen slot dimension.

Embodiment 9: The method as in any prior embodiment, wherein the running is repeated at more than one longitudinal location of the ring.

Embodiment 10: The method as in any prior embodiment, wherein the running includes a joining bead between the ring and the tool.

Embodiment 11: The method as in any prior embodiment, wherein the running is in a preformed groove of the ring.

Embodiment 12: The method as in any prior embodiment, wherein the running is at a location on the ring that is orthogonally outwardly located of another component of the tool over which the ring is to be secured.

Embodiment 13: A method for producing a ring for a downhole tool including forming the ring with a weld groove at an outside surface of the ring.

Embodiment 14: The method as in any prior embodiment, where the forming is by machining.

Embodiment 15: The method as in any prior embodiment, where the forming is by additive manufacture.

Embodiment 16: A ring for a downhole tool including a ring body, a weld groove formed in an outside surface of the ring.

Embodiment 17: The ring as in any prior embodiment, wherein the weld groove is a plurality of weld grooves.

Embodiment 18: The ring as in any prior embodiment, wherein the ring body further includes a deflection feature.

Embodiment 19: The ring as in any prior embodiment, wherein the deflection feature is a groove.

Embodiment 20: A borehole system including a borehole in a subsurface formation, a string in the borehole, and a ring as in any prior embodiment disposed on the string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a borehole, and/or equipment in the borehole, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A ring for a downhole tool comprising:

a ring body;

a weld groove formed in a circumferential direction in an outside surface of the ring prior to being disposed upon the tool.

2. The ring as claimed in claim 1, wherein the weld groove is a plurality of weld grooves.

3. The ring as claimed in claim 1, wherein the ring body further includes a deflection groove.

4. A borehole system comprising:

a borehole in a subsurface formation;

a string in the borehole; and a ring as claimed in claim 1 disposed on the string.

* * * * *